United States Patent [19]

Matsusaka

[11] Patent Number: 4,640,566

[45] Date of Patent: Feb. 3, 1987

[54] ELECTRICAL CONNECTOR HOUSING

[75] Inventor: Yoshihide Matsusaka, Kawasaki, Japan

[73] Assignee: AMP Incorporated, Harrisburg, Pa.

[21] Appl. No.: 797,282

[22] PCT Filed: Apr. 17, 1985

[86] PCT No.: PCT/US85/00696

§ 371 Date: Nov. 12, 1985

§ 102(e) Date: Nov. 12, 1985

[87] PCT Pub. No.: WO85/05501

PCT Pub. Date: Dec. 5, 1985

[30] Foreign Application Priority Data

May 17, 1984 [JP] Japan ..... 59-71100[U]

[51] Int. Cl.[4] ..... H01R 13/627

[52] U.S. Cl. ..... 339/91 R

[58] Field of Search ..... 339/91 R

[56] References Cited

U.S. PATENT DOCUMENTS

| | | | |
|---|---|---|---|
| 3,530,424 | 9/1970 | Gregory | 339/91 R |
| 3,829,821 | 8/1974 | Derr et al. | 339/91 R |
| 3,869,191 | 3/1975 | Tolnar, Jr. et al. | 339/91 R |
| 4,192,568 | 3/1980 | Marks et al. | 339/91 R |
| 4,431,244 | 2/1984 | Anhalt et al. | 339/91 R |

*Primary Examiner*—John McQuade

*Attorney, Agent, or Firm*—Adrian J. LaRue

[57] ABSTRACT

An electrical connector housing locking feature is taught. Briefly stated, the present invention provides an improved latching arm in which the electrical connector housing utilizes a latching arm which lies in a groove formed from the outer wall of the male housing and pivots at one end thereof so as to resiliently flex toward the bottom surface of the groove. The female housing has a locking member which is engageable with a portion of the latching arm thereby allowing the male and female housings to be detachably locked together.

4 Claims, 3 Drawing Figures

ELECTRICAL CONNECTOR HOUSING

The invention relates to an improvement on an electrical connector housing.

Recently, it has been desirable that an electrical connector asembled in electrical equipment and devices be of a small size, thereby enabling the equipment and devices to be lighter and smaller so that the space in which a connector is mounted is small.

Japanese Utility Registration No. 1333825 (Utility Model Publication No. 53-12458) discloses in FIG. 2 of the publication an electrical connector housing comprising a male housing portion and a female housing portion which are matable with each other. The male housing portion has a latching arm which is provided, at the outer surface thereof, with a locking projection. The latching arm lies within a groove formed in the outer wall of the male housing portion and is fixed at one end thereof so as to resiliently flex toward the bottom surface of the groove. On the other hand, the female housing portion has a locking member which is of a projection shape and which is engageable with the latching projection of the latching arm to detachably lock both housings to each other when the male housing portion is mated with the female housing portion.

The above-mentioned known electrical connector has an advantage in that the latching arm is arranged within the groove formed in the outer wall of the male housing portion, and the greater part of the latching arm is adapted to be housed within the female housing portion so that the latching arm is not influenced by an exterior force. On the other hand, however, the construction of the latching arm disclosed in the Utility Model Publication No. 53-12458 has the following problem in making the electrical connector housing smaller. Namely, in the electrical connector housing, the latching projection on the latching arm is provided so as to protrude from the upper surface of the male housing portion body, with the result that the female housing portion requires a space for receiving the latching projection in addition to a space for accommodating the male housing portion body. Therefore, the female housing portion must be formed so as to provide a space having a height corresponding to the sum of the height of the male housing portion body and the height of the latching projection. This prevents the electrical connector housing from having a low profile.

The object of the present invention is to provide an electrical connector housing with an improved latching arm in which the electrical connector housing can be formed smaller than the known electrical connector housing and in which the tangling of wires can be avoided. It is a further object of the invention to provide an electrical connector housing, comprising a male housing portion; a female housing portion which is matable with the male housing portion, characterized in that the male housing portion hs a latching arm on which a latching projection is provided, with the latching arm lying within a groove formed in an outer wall of the male housing portion and one end thereof being fixed so as to resiliently flex toward the bottom surface of the groove, the female housing portion further having a locking member which is engageable with the latching projection of the latching arm so as to detachably lock both housings from each other when the male housing portion is mated with the female housing portion, further characterized in that the latching arm is provided with a groove which extends in the longitudinal direction of the latching arm and which has the locking member therein.

An embodiment according to the present invention will now be described with reference to the accompanying drawings in which.

Figure 1:
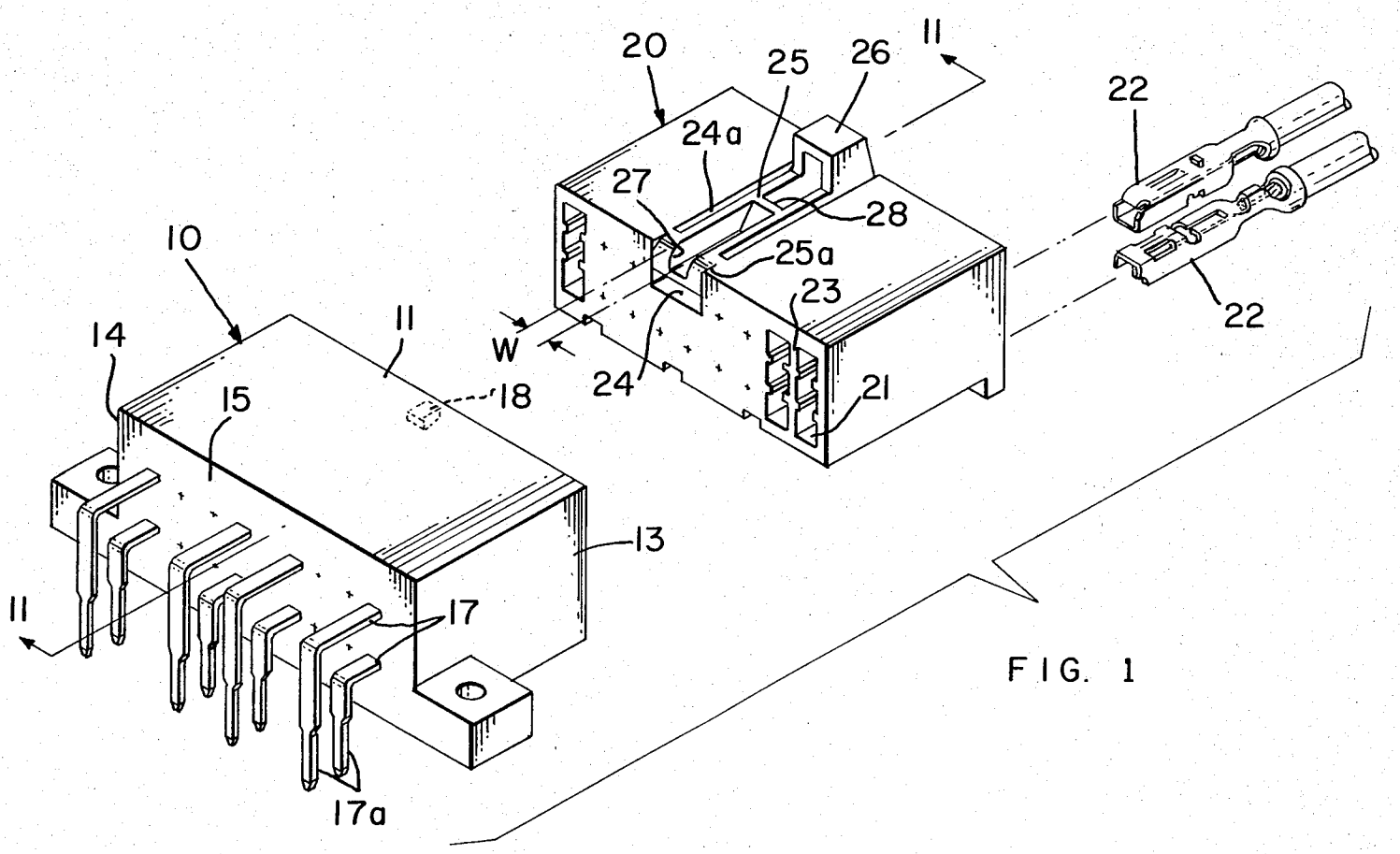
FIG. 1 shows a perspective view of the electrical connector housing which is in the unmated position according to the present invention.
Figure 2:
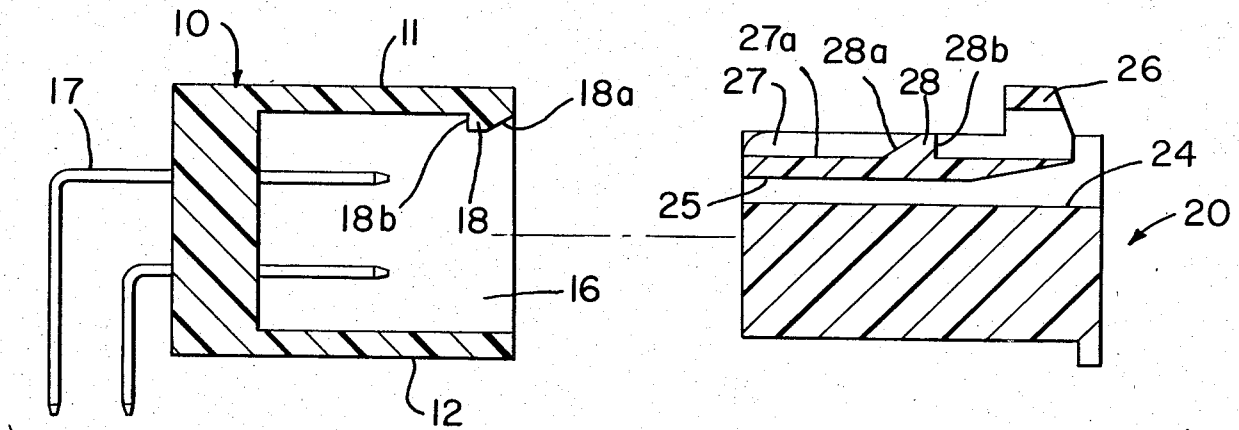
FIG. 2 shows a cross-sectional view taken along the line II—II of FIG. 1.
Figure 3:
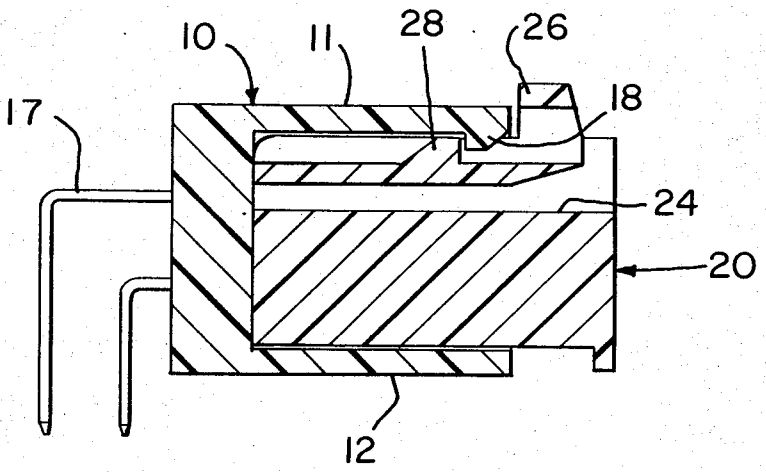
FIG. 3 shows a cross-sectional view of the mated position of FIG. 2.

The electrical connector housing comprises a female housing portion 10 and a male housing portion 20 which is matable with the female housing portion 10. The housings are formed by molding an electricl insulation plastic meterial.

The female housing portion 10 has cavity portion 16 defined by an upper wall 11 and a lower wall 12, a left side wall 13 and a right side wall 14, and a rear wall 15. A plurality of pairs of upper and lower pin contacts 17 are fixed in and through the rear wall 15 and extend into the cavity portion 16 in parallel. Each pin contact 17 has a leg portion **17*a* which projects outward form the rear wall 15 and which is bent at a right angle so as to extend downwardly. The leg portion 17*a*** is to be inserted into a hole of a printed circuit board which is not shown.

The upper wall 11 is provided, at the front inner surface thereof, with an engaging projection 18 having an inclined front portion **18*a* and a vertical back portion 18*b***.

The male housing portion 20 includes a plurality of contact cavities 21 each being spaced by a wall 23 and accommodating a pair of upper and lower receptacle contacts 22 which are matable with the pair of upper and lower pin contacts 17 within the female housing portion 10.

The male housing portion 20 has at the upper side thereof a groove 24 which extends rearward from the mating surface of the housing. Within the groove 24 is provided a latching arm 25, the front end of which is fixed at the forward end portions of side walls **24*a* through lateral arms 25*a* so that the latching arm 25** can resiliently flex about the fixed end thereof.

The latching arm 25 is arranged so as to extend within the groove 24 from th fixed end rearward and so that the upper surfaces of the latching arm 25 and of the male housing portion body are coplanar. THe latching arm 25 has at the rear free end thereof a pressing protrusion 26 which projects upward from the groove 24. The latching arm 25 also has a groove 27 which extends from the fixed front end surface of the latching arm 25 in a longitudinal direction and which has a latching projection 28 at the intermediate portion thereof.

The groove 27 is formed so as to have a width "W" within which the engaging projection 18 of the female housing portion 10 can be received. Therefore, in mating the male housing portion 20 with the female housing portion 10, the groove 27 serves as a guide means to guide accurately the female housing portion 10 by engaging the groove 27 with the engaging projection 18.

The latching projection 28 extends from the bottom surface **27*a* of the groove 27 so as to define an inclined front surface 28*a* and a vertical rear surface 28*b* and terminates at the upper surface of the latching arm 25**.

In mating the housings 10 and 20 with each other in the above-mentioned construction, the housings are arranged such that the front surface of the male housing portion 20 faces the cavity portion 16 of the female housing portion 10, and when the male housing portion 20 is inserted into the female housing portion 10, the engaging projection 18 of the female housing portion 10 is guided along the groove 27 of the latching arm 25 and the inclined front portion 18*a* abuts with the inclined surface 28*a* of the latching projection 28 so as to flex the latching arm toward the bottom surface of the groove 24. When the mating of both housings is further proceeded and when the engaging projection 18 depresses further the latching arm 25, the engaging projection 18 climbs over the latching projection 28 and the latching arm 25 returns resilient to its original position so that the vertical portion 18*b* of the engaging projection 18 engages the vertical surface 28*b* of the latching projection 28 to lock both housings to each other. Conversely, the release of the lock of both housings can be accomplished by pressing downward the pressing protrusion 26 of the latching arm 25 so as to disengage the engaging projection 18 from the latching projection 28 and by pulling out either housing from the other housing.

According to the present, which is as mentioned above, the construction is such that the latching projection of the latching arm is arranged within the groove formed in the latching arm and so not to protrude from the upper surface of the male housing portion body, and therefore, the female housing portion does not need a space for accommadating the latching projection and, thereby, an electrical connector housing which is smaller than the known electrical connector housing can be obtained. Also, when the latching projection climbs over the engaging projection by the mating of both housings and at the moment that the latching arm resiliently returns to its original position, the whole upper surface of the latching arm hits the inner surface of the female housing portion so as to make a loud clicking sound so that the operator can easily perceive the complete mating of both housings.

I claim:

1. An electrical connector housing, comprising:

a male housing portion;

a female housing portion which is matable with male housing portion, characterized in that:

the male housing portion has a latching arm on which a latching portion is provided, with the latching arm lying within a groove formed in an outer wall of the male housing portion and one end thereof being fixed so as to resilently flex toward the bottom surface of the groove, the female housing portion further having a locking member which is engageable with the latching projection of the latching arm so as to lock both housings with each other when the male housing portion is mated with the female housing portion, further characterized in that:

the latching arm is provided with a groove which extends in the longitudinal direction of the latching arm and which has the latching projection therein.

2. An electrical connector, comprising:

a first dielectric housing member and a second dielectric housing member, said housing members having matable sections and including passageway extending therethrough:

electrical contact means secured in said passageway means for matable elecrical engagement when said matable sections are mated;

a latch arm on said first housing member and extending along a housing member so as to flex within said recess, said latch arm having a recess of said first housing member, said latch arm being fixed to said first groove extending along an outer surface thereof, a first latching projection in said groove;

a second latching projection on said second housing member which engages with said first latching projection in said groove when said matable sections are mated thereby latching the housing members together.

3. An electrical connector as claimed in claim 2, wherein said latch arm is fixed at an end to said first housing member.

4. An electrical connector as claimed in claim 2, wherein said latching projectins have inclined front surfaces and vertical rear surfaces.

* * * * *

UNITED STATES PATENT OFFICE

CERTIFICATE OF CORRECTION

Patent No. 4,640,566 Dated February 3, 1987

Inventor(s) Yoshihide Matsusaka

It is certified that error appears in the above-identified patent and that said Letters Patent are hereby corrected as shown below:

Claim 2, column 4, lines 26 through 31 should be replaced with the following:

a latch arm on said first housing member and extending along a recess of said first housing member, said latch arm being fixed to said first housing member so as to flex within said recess, said latch arm having a groove extending along an outer surface thereof, a first latching projection in said groove;

Signed and Sealed this

Twenty-first Day of April, 1987

*Attest:*

*Attesting Officer*

DONALD J. QUIGG

*Commissioner of Patents and Trademarks*